US006860329B1

(12) United States Patent
Oosterling

(10) Patent No.: US 6,860,329 B1
(45) Date of Patent: Mar. 1, 2005

(54) APPARATUS FOR AND METHOD OF INCLUDING A PACKER TO FACILITATE ANCHORING A FIRST CONDUIT TO A SECOND CONDUIT

(75) Inventor: Peter Oosterling, Berkel en Roderijs (NL)

(73) Assignee: e² Tech Limited, Aberdeen (GB)

( * ) Notice: Subject to any disclaimer, the term of this patent is extended or adjusted under 35 U.S.C. 154(b) by 0 days.

(21) Appl. No.: 10/069,992

(22) PCT Filed: Sep. 6, 2000

(86) PCT No.: PCT/GB00/03406

§ 371 (c)(1),
(2), (4) Date: Jun. 6, 2002

(87) PCT Pub. No.: WO01/18354

PCT Pub. Date: Mar. 15, 2001

(30) Foreign Application Priority Data

Sep. 6, 1999 (GB) ..... 9920935

(51) Int. Cl.[7] ..... E21B 29/00

(52) U.S. Cl. ..... 166/298; 166/387; 166/55.1; 166/207

(58) Field of Search ..... 166/297, 298, 166/382, 387, 55, 55.1, 207, 212

(56) References Cited

U.S. PATENT DOCUMENTS

| | | | | | |
|---|---|---|---|---|---|
| 3,353,599 | A | * | 11/1967 | Swift | 166/207 |
| 3,412,565 | A | | 11/1968 | Lindsey et al. | |
| 3,529,667 | A | * | 9/1970 | Malone | 166/387 |
| 5,027,894 | A | * | 7/1991 | Coone et al. | 166/122 |
| 5,220,959 | A | * | 6/1993 | Vance, Sr. | 166/212 |
| 5,297,633 | A | * | 3/1994 | Snider et al. | 166/387 |
| 5,695,008 | A | | 12/1997 | Bertet et al. | |
| 5,833,001 | A | | 11/1998 | Song et al. | |
| 6,085,838 | A | | 7/2000 | Vercaemer et al. | |
| 6,253,850 | B1 | * | 7/2001 | Nazzai et al. | 166/207 |
| 6,321,847 | B1 | * | 11/2001 | Brown | 166/212 |
| 6,454,013 | B1 | | 9/2002 | Metcalfe | |
| 2003/0183395 | A1 | * | 10/2003 | Jones | 166/207 |

FOREIGN PATENT DOCUMENTS

| | | |
|---|---|---|
| GB | 2344606 | 6/2000 |
| WO | WO 9706346 | 2/1997 |
| WO | WO 9923354 | 5/1999 |

* cited by examiner

*Primary Examiner*—David Bagnell
*Assistant Examiner*—Matthew J. Smith
(74) *Attorney, Agent, or Firm*—Moser, Patterson & Sheridan, L.L.P.

(57) ABSTRACT

Apparatus and methods are disclosed for anchoring a first conduit to a second conduit. The first conduit is typically an expandable conduit whereby at portion of the first conduit is expanded by applying a radial force thereto to provide an anchor and/or seal between the first and second conduits. An inflatable device is provided that can be used to provide a temporary anchor while the first (expandable) conduit is radially expanded. An expander device that is capable of applying a radial expansion force to the first conduit is optionally attached to the inflatable device.

21 Claims, 6 Drawing Sheets

16
24
22
14
14b
14r
10

20
16
24
22
14
14b
14r
10

20
12
16
22
14
14b
14r
10a 20
12
16
22
14
14b
14r
12i
10
10s
10l
18

52
36
32
34
42
40
40r
48
38
30
30l
44
50
40b 86
88
84
82
80

82
86
84
84b
84r
80

82
86
88
84
84b
84r
80

82
86
88
84
84b
84r
80
80s
80L

APPARATUS FOR AND METHOD OF INCLUDING A PACKER TO FACILITATE ANCHORING A FIRST CONDUIT TO A SECOND CONDUIT

CROSS REFERENCE TO RELATED APPLICATIONS

This application is the U.S. national phase application of PCT International Application No. PCT/GB00/03406, filed. Sep. 6, 2000.

FIELD OF THE INVENTION

The present invention relates to an apparatus for and a method of anchoring a first conduit to a second conduit, the apparatus and method particularly, but not exclusively, using an inflatable device to provide a temporary anchor.

BACKGROUND OF THE INVENTION

A borehole is conventionally drilled during the recovery of hydrocarbons from a well, the borehole typically being lined with a casing. Casings are installed to prevent the formation around the borehole from collapsing. In addition, casings prevent unwanted fluids from the surrounding formation from flowing into the borehole, and similarly, prevents fluids from within the borehole escaping into the surrounding formation.

Boreholes are conventionally drilled and cased in a cascaded manner; that is, casing of the borehole begins at the top of the well with a relatively large outer diameter casing. Subsequent casing of a smaller diameter is passed through the inner diameter of the casing above, and thus the outer diameter of the subsequent casing is limited by the inner diameter of the preceding casing. Thus, the casings are cascaded with the diameters of the casing lengths reducing as the depth of the well increases. This gradual reduction in diameter results in a relatively small inside diameter casing near the bottom of the well that could limit the amount of hydrocarbons that can be recovered. In addition, the relatively large diameter borehole at the top of the well involves increased costs due to the large drill bits required, heavy, equipment for handling the larger casing, and increased volumes of drill fluid that are required.

Each casing is typically cemented into place by filling cement into an annulus created between the casing and the surrounding formation. A thin slurry cement is pumped down into the casing followed by a rubber plug on top of the cement. Thereafter, drilling fluid is pumped down the casing above the cement that is pushed out of the bottom of the casing and into the annulus. Pumping of drilling fluid is stopped when the plug reaches the bottom of the casing and the wellbore must be left, typically for several hours, whilst the cement dries. This operation requires an increase in rig time due to the cement pumping and hardening process, that can substantially increase production costs.

It is known to use a pliable casing that can be radially expanded so that an outer surface of the casing contacts the formation around the borehole. The pliable casing undergoes plastic deformation when expanded, typically by passing an expander device, such as a ceramic or steel cone or the like, through the casing. The expander device is propelled along the casing in a similar manner to a pipeline pig and may be pushed (using fluid pressure for example) or pulled (using drill pipe, rods, coiled tubing, a wireline or the like).

Lengths of expandable casing are coupled together (typically by threaded couplings) to produce a casing string.

The casing string is inserted into the borehole in an unexpanded state and is subsequently expanded using the expander device, typically using a substantial force to facilitate the expansion process. However, the unexpanded casing string requires to be anchored either at or near an upper end or a lower end thereof during the expansion process to prevent undue movement. This is because when the casing string is in an unexpanded state, an outer surface of the casing string does not contact the surrounding borehole formation or an inner face of a pre-installed casing or liner (until at least a portion of the casing has been radially expanded), and thus there is no inherent initial anchoring point.

Slips are conventionally used to temporarily anchor the unexpanded casing to the borehole during the expansion process. Slips are generally wedge-shaped, steel, hinged portion that provide a temporary anchor when used. Slips are actuated whereby the wedge-shaped portions engage with the surrounding borehole formation or a casing or liner.

However, the mechanical configuration of slips often causes damage to the casing or liner. In some cases, the damage causes the slip to fail due to a loss of mechanical grip. Slip-type devices in open-hole engaging formation are often prone to slippage also.

SUMMARY OF THE INVENTION

According to a first aspect of the present invention, there is provided an apparatus for anchoring a first conduit to a second conduit, the apparatus comprising an inflatable device for engaging with the first conduit, wherein the inflatable device is inflatable to facilitate anchoring of the first conduit to the second conduit.

According to a second aspect of the present invention, there is provided a method of anchoring a first conduit to a second conduit, the method comprising the steps of providing a first conduit, providing an inflatable device in contact with the first conduit, running the first-conduit and inflatable device into the second conduit, and subsequently inflating the inflatable device to facilitate anchoring of the first conduit to the second conduit.

According to a third aspect of the present invention, there is provided a method of anchoring an expandable conduit to a second conduit, the method comprising the steps of providing an expandable conduit, running the first conduit into the second conduit, passing an inflatable device into the conduit, and subsequently inflating the inflatable device to facilitate anchoring of the expandable conduit to the second conduit.

The first conduit is typically an expandable conduit.

The first or expandable conduit may comprise any type of expandable conduit that is capable of sustaining plastic and/or elastic deformation. The first conduit typically comprises an expandable liner, casing or the like. The second conduit may comprise any type of conduit. The second conduit typically comprises a liner, casing, borehole or the like.

The inflatable device typically comprises an inflatable balloon-type portion coupled to a ring. This allows a string or the like to be passed through the inflatable device in use.

Optionally, the inflatable device includes an expander device. The expander device is optionally telescopically coupled to the inflatable device, so that when the expander device is moved a certain distance, the inflatable device is deflated and subsequently moves with the expander device.

Alternatively, the expandable device may be releasably attached to the inflatable device, typically using a latch mechanism.

The inflatable device may be located within the expandable conduit. Alternatively, the inflatable device may be coupled at or near an upper end of the expandable conduit, or at or near a lower end of the expandable conduit. The inflatable device may be coupled to the expandable conduit using any suitable connection.

The inflatable device is typically inflated to expand the expandable conduit whereby the expandable conduit contacts the second conduit, thereby providing an anchor. In this embodiment, the expandable conduit is optionally provided with a slotted portion to facilitate expansion. This is advantageous as the contact between the expandable conduit and the second conduit provides the anchor, and forces applied to the expandable conduit are mainly channelled into the second conduit via the expandable conduit and not the inflatable device.

Alternatively, the inflatable device is inflated whereby a portion thereof directly contacts the second conduit to provide an anchor.

The expander device is typically manufactured from steel. Alternatively, the expander device may be manufactured from ceramic, or a combination of steel and ceramic. The expander device is optionally flexible.

The expander device is optionally provided with at least one seal. The seal typically comprises at least one O-ring.

The method optionally comprises one, some or all of the additional steps of inserting an expander device into the expandable conduit, operating the expander device to expand the expandable conduit, deflating the inflatable device, and removing the expander device and/or the inflatable device from the expandable conduit and/or the second conduit.

The method optionally comprises one, some or all of the additional steps of attaching an expander device to the inflatable device, operating the expander device to expand the expandable conduit, re-attaching the expander device to the inflatable device, deflating the inflatable device, and removing the expander device and/or the inflatable device from the expandable conduit and/or second conduit.

The expander device is typically operated by propelling it through the expandable conduit using fluid pressure. Alternatively, the expander device may be operated by pigging it along the expandable conduit using a conventional pig or tractor. The expander device may also be operated by propelling it using a weight (from the string for example), or may by pulling it through the expandable conduit (e.g. using drill pipe, rods, coiled tubing, a wireline or the like).

Optionally, the inflatable device may act as a seal whereby fluid pressure can be applied below the seal.

BRIEF DESCRIPTION OF THE DRAWINGS

Embodiments of the present invention shall now be described, by way of example only, with reference to the accompanying drawings, in which.

DETAILED DESCRIPTION OF THE INVENTION

Figures 1A, 1B, 1C, 1D:
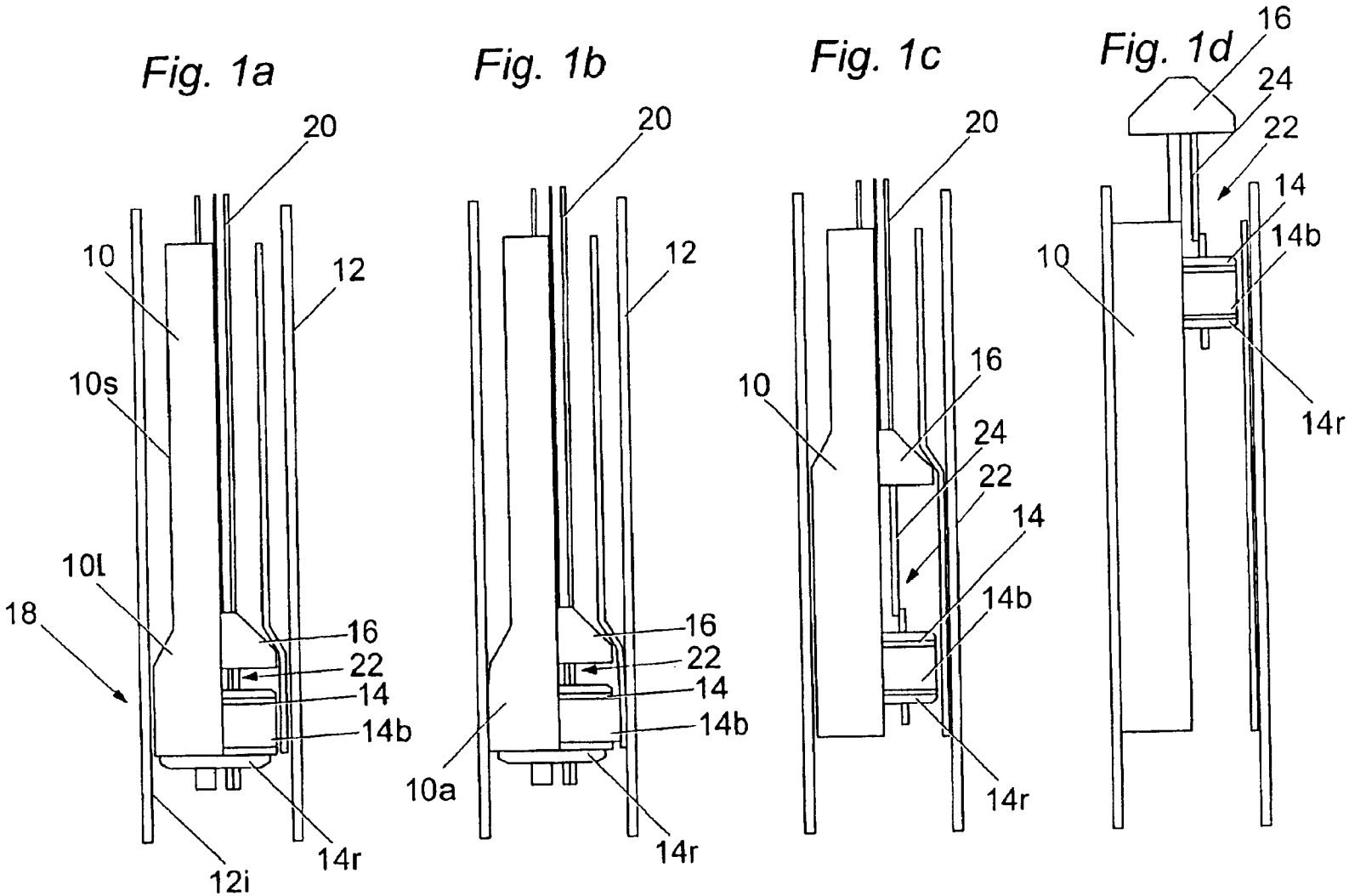
FIGS. 1*a* to 1*d* are successive stages in anchoring and expanding an expandable conduit within a second conduit using a first embodiment of an inflatable device.

Referring to FIG. 1, there is shown in sequence (FIGS. 1*a* to 1*d*) successive stages of anchoring an expandable conduit 10 to a casing 12 provided in a borehole (not shown), the borehole typically being drilled to facilitate the recovery of hydrocarbons. The expandable conduit 10 is typically an expandable liner or casing, but any type of expandable conduit may be used.

The borehole is conventionally lined with casing 12 to prevent the formation around the borehole from collapsing and also to prevent unwanted fluids from the surrounding formation from flowing into the borehole, and similarly, prevents fluids from within the borehole escaping into the surrounding formation. It should be noted that the casing 12 may comprise any type of conduit, such as a pipeline, a liner, a casing, a borehole or the like.

An inflatable device 14, that in this embodiment has an expander device 16 telescopically attached thereto, is positioned within the expandable conduit 10 before the conduit 10 is inserted into the casing 12.

Referring to FIG. 1*a*, the conduit 10 with the inflatable device 14 and expander device 16 located therein is run into the hole to the required setting depth. As can be seen in FIG. 1*a*, a lower end 10*l* of the expandable conduit 10 is radially expanded (indicated generally at 18) to allow the inflatable device 14 and the expander device 16 to be located therein. It will be appreciated that although FIGS. 1*a* to 1*d* show the inflatable device 14 and expander device 16 located at or near the lower end 10*l* of the conduit 10, the inflatable device 14 and/or the expander device 16 may also be located at or near an upper end of the conduit 10. In this case, the expander device 16 is propelled downwardly using, for example, the weight of a string, fluid pressure or any other conventional method.

The inflatable device 14 may be of any suitable configuration, but is typically a device that has an inflatable annular balloon-type portion 14*b* that is mounted on an annular ring 14*r*. The annular ring 14*r* allows a string, wireline or the like to be passed through the inflatable device 14 as required. This is particularly advantageous where the inflatable device 14 is positioned at the upper end of the conduit 10. Thus, substantially full-bore access is still possible.

Referring to FIG. 1*b*, the inflatable device 14 is inflated to expand the inflatable annular balloon-type portion 14*b*. As the balloon-type portion 14*b* expands, an anchor portion 10*a* of the conduit 10 is also expanded. The anchor portion 10*a* is expanded by the inflatable device 14 until it contacts the casing 12, as shown in FIG. 1*b*. This contact between the anchor portion 10*a* of the expandable conduit 10 and casing 12 provides an anchor point and/or a seal between the expandable conduit 10 and the casing 12. The outer surface of the anchor portion 10*a* may be suitably profiled (e.g. ribbed) or coated with a friction and/or sealing material 100 (FIGS. 4*a* to 4*c*) to enhance the grip of the conduit 10 on the casing 12. The friction and/or sealing material 100 may comprise, for example, any suitable type of rubber or other resilient materials. It should be noted that the friction and/or sealing material 100 can be provided on an outer surface 10*s* of the conduit 10 at various axially spaced-apart locations.

Figures 4A, 4B, 4C:
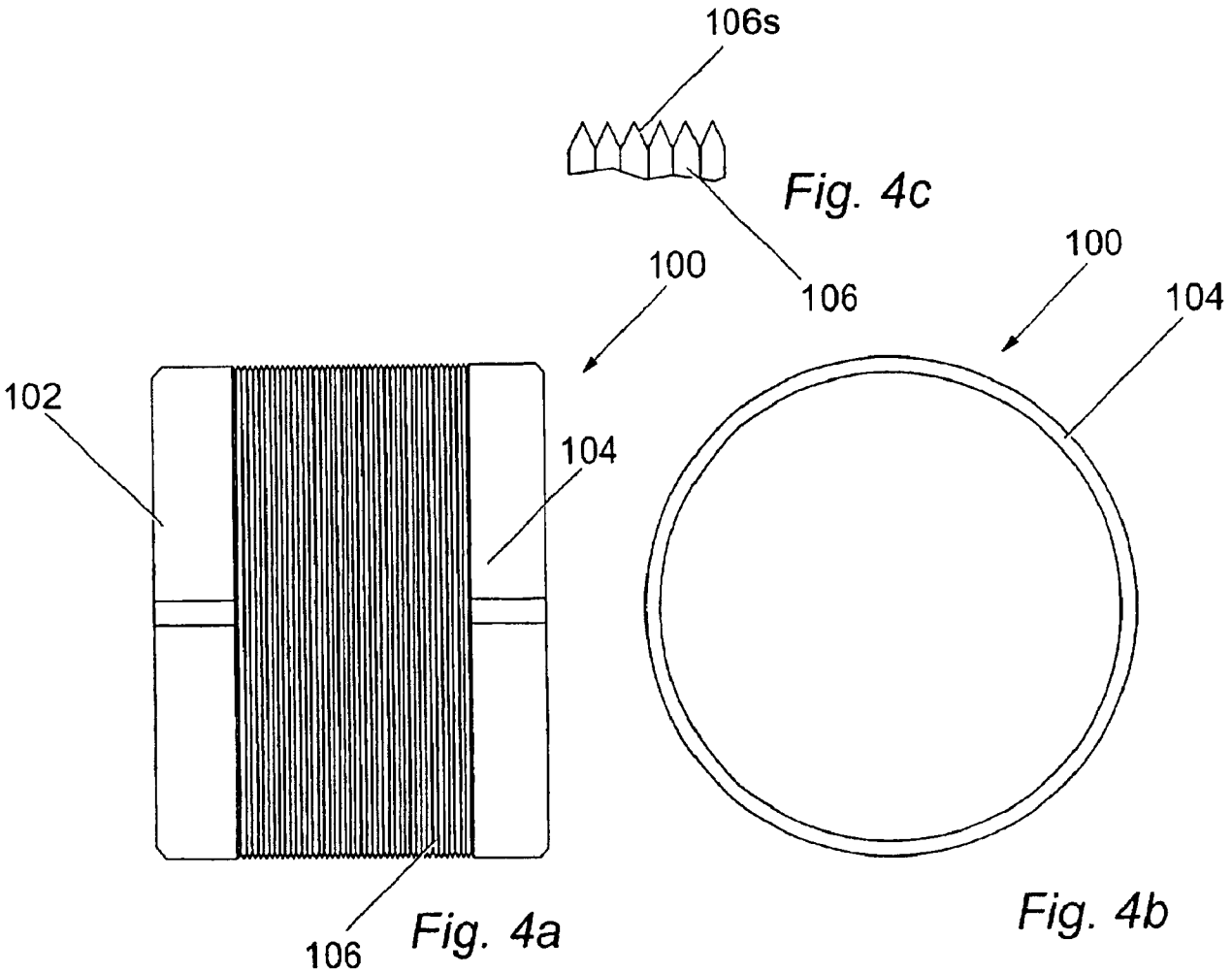
FIG. 4*a* is a front elevation showing a first configuration of a friction and/or sealing material that can be applied to an outer surface of the conduits shown in FIGS. 1 to 3.
FIG. 4*b* is an end elevation of the friction and/or sealing material of FIG. 4*a;*
FIG. 4*c* is an enlarged view of a portion of the material of FIGS. 4*a* and 4*b* showing a profiled outer surface.

Referring to FIGS. 4*a* to 4*c*, the friction and/or sealing material 100 typically comprises first and second bands 102, 104 that are axially spaced apart along a longitudinal axis of the conduit 12. The first and second bands 102, 104 are typically axially spaced by some distance, for example 3 inches (approximately 76 mm).

The first and second bands 102, 104 are preferably annular bands that extend circumferentially around the anchor point 10*a* of the conduit 10, although this configuration is not essential. The first and second bands 102, 104 typically comprise 1 inch wide (approximately 25.4 mm) bands of a first type of rubber. The friction and/or sealing material 100 need not extend around the full circumference of the conduit 10.

Located between the first and second bands 102, 104 is a third band 106 of a second type of rubber. The third band 106 preferably extends between the first and second bands 102, 104 and is thus typically 3 inches (approximately 76 mm) wide.

The first and second bands 102, 104 are typically of a first depth. The third band 106 is typically of a second depth. The first depth is optionally larger than the second depth, although they are typically the same, as shown in FIG. 4*a*. The first and second bands 102, 104 may protrude further from the surface 10*s* than the third band 106, although this is not essential.

The first type of rubber (i.e. first and second bands 102, 104) is preferably of a harder consistency than the second type of rubber (i.e. third band 106). The first type of rubber is typically 90 durometer rubber, whereas the second type of rubber is typically 60 durometer rubber. Durometer is a conventional hardness scale for rubber.

The particular properties of the rubber may be of any suitable type and the hardnessess quoted are exemplary only. It should also be noted that the relative dimensions and spacings of the first, second and third bands 102, 104, 106 are exemplary only and may be of any suitable dimensions and spacing.

As can be seen from FIG. 4*c* in particular, an outer face 106*s* of the third band 106 can be profiled. The outer face 106*s* is ribbed to enhance the grip of the third band 106 on an inner face 12*i* of the casing 12. It will be appreciated that an outer surface on the first and second bands 102, 104 may also be profiled (e.g. ribbed).

The two outer bands 102, 104 being of a harder rubber provide a relatively high temperature seal and a back-up seal to the relatively softer rubber of the third band 106. The third band 106 typically provides a lower temperature seal.

Figure 5:
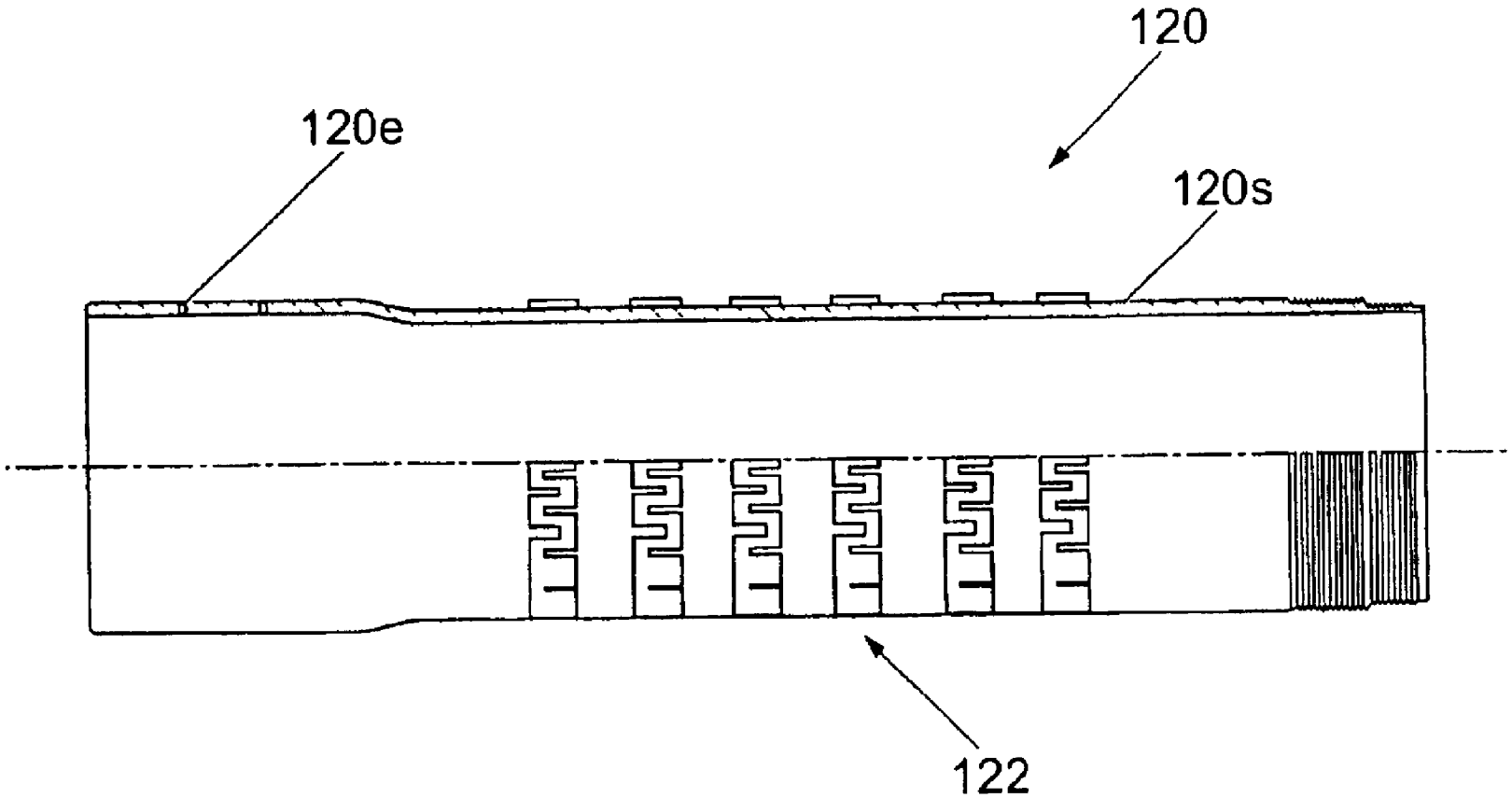
FIG. 5 is a schematic cross-section of an expandable conduit that can be used with the present invention having an alternative configuration of a friction and/or sealing material.

Referring to FIG. 5, there is shown an alternative conduit 120 that can be used in place of conduit 10. Conduit 120 is substantially the same as conduit 10, but is provided with a different configuration of friction and/or sealing material 122 on an outer surface 120*s*.

The expandable conduit 120 is provided with a pre-expanded portion 120*e* in which an expander device (e.g. expander device 16) and/or an inflatable device (e.g. device 14) may be located whilst the conduit 120 is run into a borehole or the like. It should be noted that the expander device need not be located in the conduit 120 whilst it is being run into the borehole, and can be located in the conduit 120 once it is in place.

As shown in FIG. 5, the expandable conduit 120 is provided with the friction and/or sealing material 122 at at least one location. The friction and/or sealing material 122 is applied to the outer surface 120*s* of the conduit 120 at axially spaced apart locations, typically spaced from one another by around 12 inches (approximately 305 mm).

Figure 6B:
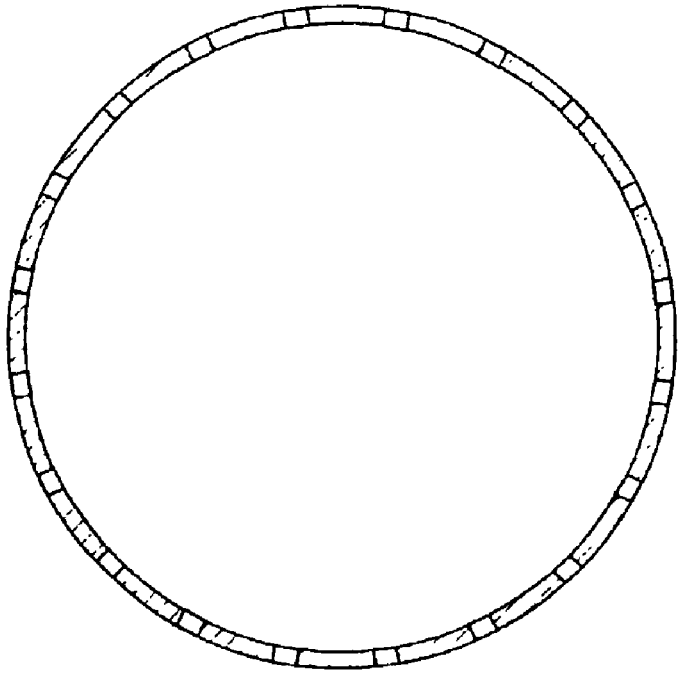
FIG. 6*b* is an end elevation of the friction and/or sealing material of FIG. 6*a*.
Figure 6A:
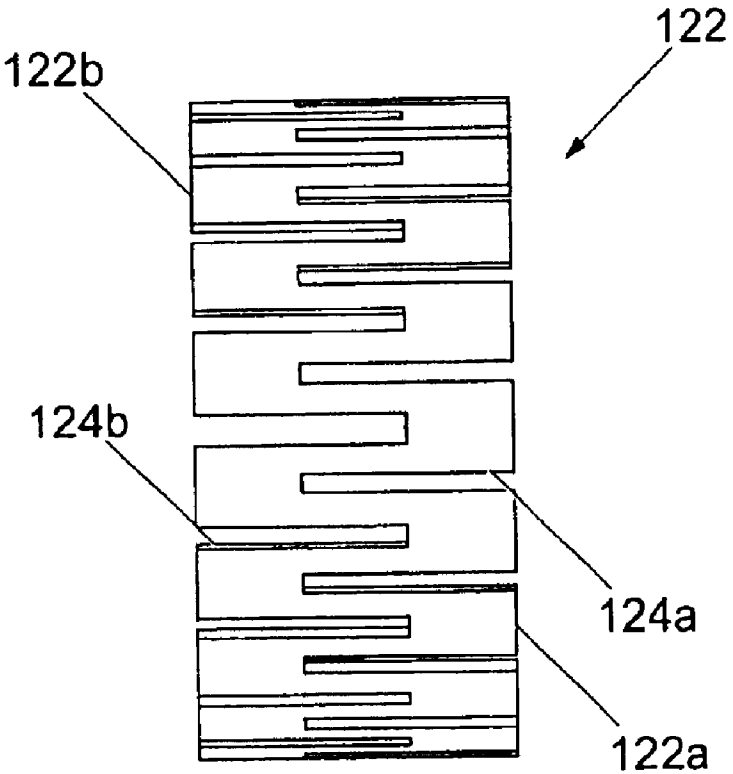
FIG. 6*a* is an front elevation of the friction and/or sealing material of FIG. 5.

The friction and/or sealing material 122 is best shown in FIGS. 6*a* and 6*b*. The friction and/or sealing material 122 is in the form of a zigzag. In this embodiment, the friction and/or sealing material 122 comprises a single (preferably annular) band of rubber that is, for example, of 90 durometers hardness and is about 2.5 inches (approximately 28 mm) wide by around 0.12 inches (approximately 3 mm) deep.

To provide a zigzag pattern and hence increase the strength of the grip and/or seal that the formation 150 provides in use, a number of slots 124*a*, 124*b* (e.g. 20) are milled into the band of rubber. The slots 124*a*, 124*b* are typically in the order of 0.2 inches (approximately 5 mm) wide by around 2 inches (approximately 50 mm) long.

To create the zigzag pattern, the slots 124*a* are milled at around 20 circumferentially spaced-apart locations, with around 18° between each along one edge 122*a* of the band. The process is then repeated by milling another 20 slots 124*b* on the other side 122*b* of the band, the slots 124*b* on side 122*b* being circumferentially offset by 9° from the slots 124*a* on the other side 122*a*.

In use, the friction and/or sealing material 122 is applied to the outer surface 120*s* of the (unexpanded) expandable conduit 120. It should be noted that the configuration, number and spacing of the friction and/or sealing material. 122 can be chosen to suit the particular application.

It should be noted that forces applied to the conduit 10, 120 e.g. by subsequent movement of the conduit 10, 120 that is by pushing or pulling on the conduit 10, 120 for example, will be mainly transferred to the casing 12 via the anchor point and not through the inflatable device 14. This is advantageous as it reduces the risk of damage to the inflatable device 14. Additionally, this also reduces the risk of damage to the casing 12 that may have occurred where a conventional slip is used. Also, conventional slips may lose their grip on the casing 12 where damage ensues or the casing 12 is weak. Transferring substantially all of the forces directly to the casing 12 via the anchor point obviates these disadvantages.

The expander device 16 can then be pulled through the expandable conduit 10, 120 to radially expand the conduit 10, 120 as shown in FIG. 1*c*. The expander device 16 can be propelled through the conduit 10, 120 in any conventional manner. In FIG. 1, the expander device 16 is pulled through the conduit 10, 120 using a string 20 that is attached to the expander device 16 in any conventional manner.

In the embodiment shown in FIG. 1, the expander device 16 is telescopically coupled to the inflatable device 14 using a telescopic coupling, generally indicated at 22. Coupling 22 comprises one or more telescopically coupled members 24 that are attached to the inflatable device 14. As the expander device 16 is pulled upwards, the telescopic coupling 22 extends a certain distance, say 10 feet (approximately 3 meters), at which point the telescopic member(s) 24 are fully extended. At this point, the inflatable balloon-type portion

14*b* is automatically deflated and further upward movement of the expander device 16 causes the inflatable device 14 also to move upward, as shown in FIG. 1*d*.

It should be noted that the inflatable device 14 is no longer required to anchor the conduit 10, 120 to the casing 12 as the expanded conduit 10 (FIGS. 1*c* and 1*d*) secure the (expanded and unexpanded) conduit 10, 120 to the casing 12. The friction and/or sealing material 100, 122 is used to enhance the grip of the conduit 10, 120 on the casing 12 in use, and can also provide a seal in an annulus created between the conduit 10, 120 and the casing 12.

The expander device 16 is continually pulled upwards towards the surface until the expandable conduit 10, 120 is fully expanded to contact the casing 12. Thereafter, the inflatable device 14 and the expander device 16 may be removed from the expandable conduit 10, 120 and/or the casing 12 at the surface.

Anchoring and expanding the expandable conduit 10, 120 in this way has several advantages. With the embodiment shown in FIG. 1, it is possible to deploy a control line or coiled tubing to control operation of the inflatable device 14 and any other apparatus located in the borehole, and a control line, wireline or coiled tubing may be used to propel or pull the expander device 16. With the embodiment shown in FIG. 1, there is no pressure exposure to the surrounding formation and no rig is required. With the inflatable device 14 configured as an annular ring 14*r*, substantially full bore access is still possible.

It should be noted that the method described with reference to FIG. 1 is intended to expand the expandable conduit 10, 120 in a single pass of the expander device 16 through the expandable conduit 10, 120, but multiple passes and/or expansions are possible.

Figures 2A, 2B, 2C, 2D:
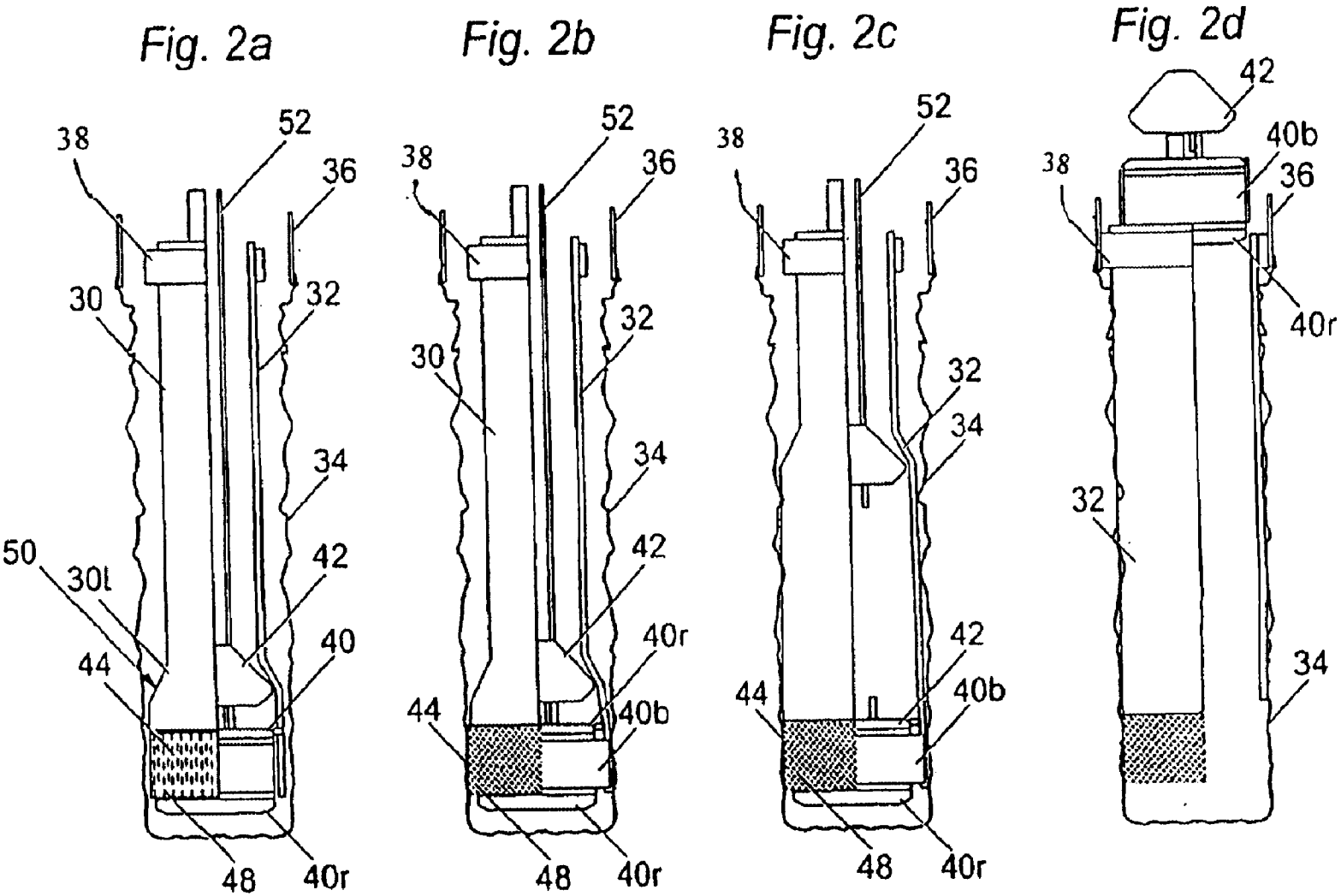
FIGS. 2*a* to 2*d* are successive stages in anchoring and expanding an expandable conduit within a borehole to tie back the expandable conduit to a casing using a second embodiment of an inflatable device.

Referring to FIG. 2, there is shown in sequence (FIGS. 2*a* to 2*d*) successive stages of hanging an expandable conduit 30 off a casing 32 (ie tying back a liner), the expandable conduit 30 typically comprising an expandable liner and being used to line or case a lower portion of a borehole 34, the borehole 34 typically being drilled to facilitate the recovery of hydrocarbons. The lower portion of the borehole 34 has not been lined/cased, wherein the upper portion of the borehole 34 has been lined with an existing casing or liner 36.

In the embodiment shown in FIG. 2, the expandable conduit 30 is provided with a friction and/or sealing material 38 on an outer surface thereof. The function of the friction and/or sealing material 38 is to provide a (friction and/or sealing) coupling between the expandable conduit 30 and the existing liner or casing 36. The friction and/or sealing material 38 may also provide a seal between the lower (unlined) and upper (lined) portions of the borehole 34 The friction and/or sealing material may comprise, for example, any suitable type of rubber or other resilient materials. For example, the friction and/or sealing material 38 can be configured in a similar way to the friction and/or sealing material 100, 122 described above with reference to FIGS. 4 to 6.

Additionally, the conduit 30 may be provided with friction and/or sealing material (e.g. material 100, 122) at a lower end 30*l* of the conduit 30 to enhance the anchoring effect at this portion of the conduit. Additionally, the friction and/or sealing material can be provided at various spaced-apart locations along the length of the conduit 30 to enhance the coupling between the conduit 30 and the borehole 34 or casing. 36.

Referring to FIG. 2, an inflatable device 40, that has an expander device 42 releasably attached thereto, is positioned within the expandable conduit 30 before the conduit 30 is inserted into the borehole 34. The conduit 30 is provided with an expandable portion of casing or liner 44, portion 44 being provided with a plurality of longitudinal slots 48. The portion 44 may be located at a lower end 30*l* of the conduit 30 or may be integral therewith.

Referring to FIG. 2*a*, the conduit 30 with the inflatable device 40 and expander device 42 releasably attached at or near a lower end thereof, is run into the borehole 34 to the required setting depth. As can be seen in FIG. 2*a*, a lower end 30*l* of the conduit 30 is radially expanded (indicated generally at 50) to allow the expander device 42 to be located therein. It will be appreciated that although FIGS. 2*a* to 2*d* show the inflatable device 40 and expander device 42 located at or near the lower end 30*l* of the conduit 30, the inflatable device 40 and/or the expander device 42 may also be located at or near an upper end of the conduit 30. In this case, the expander device 42 is propelled downwardly using, for example, the weight of a string, fluid pressure or any other conventional method.

The inflatable device 40 may be of any suitable configuration, but is typically a device that has an inflatable annular balloon-type portion 40*b* that is mounted on an annular ring 40*r*. The annular ring 40*r* allows a string, wireline or the like to be passed through the inflatable device 40 as required. This is particularly advantageous where; the inflatable device 40 is positioned at the upper end of the conduit 30.

Referring to FIG. 2*b*, the inflatable device 40 is inflated to expand the inflatable annular balloon-type portion 40*b*. As the balloon-type portion 40*b* expands, the expandable portion 44 of conduit 30 also expands. As can be seen in FIG. 2*b*, the longitudinal slots 48 widen as the portion 44 expands. Portion 44 acts as an anchor for the casing 30 and is expanded until it contacts the borehole 34, as shown in FIG. 2*b*. This contact between portion 44 and the borehole 34 provides an anchor point and/or a seal between the expandable conduit 30 (to which portion 44 is attached or integral therewith) and the borehole 34.

As with the previous embodiment, the expander device 42 is then pulled through the expandable conduit 30 to radially expand the conduit 30, as shown in FIG. 2*c*. The expander device 42 can be propelled through the conduit 30 in any conventional manner. In FIG. 2, the expander device 42 is pulled through the conduit 30 using a drill pipe or string 52 that is attached to the expander device 42 in any conventional manner.

As the expander device 42 is pulled upwards, the upward movement thereof is stopped after a predetermined time or distance, at which point the expander device 42 is lowered until a coupling between the expander device 42 and the inflatable device 40 latches. As with the previous embodiments, the inflatable annular balloon-type portion 40*b* is automatically deflated and further upward movement of the expander device 42 causes the inflatable device 40 also to move upward, as shown in FIG. 2*d*. It should be noted that the upward movement of the expander device 42 should only be stopped once a sufficient length of conduit 30 has been expanded to provide a sufficient anchor.

It should also be noted that the portion 44 is no longer required to anchor the conduit 30 to the borehole 34 as the expanded conduit 30 (FIGS. 2*c* and 2*d*) secures the conduit 30 to the borehole 34. The friction and/or sealing material (where used) can help to provide a reliable anchor for the conduit 30 whilst it is being expanded and also when in use.

The expander device 42 is continually pulled upwards until the conduit 30 is fully expanded, as shown in FIG. 2*d*

Thereafter, the inflatable device 40 and the expander device 42 may be removed from the expandable conduit 30 and the borehole at the surface. As shown in FIG. 2*d*, the conduit 30 expands whereby the friction and/or sealing material 38 contacts the casing 36. This provides a tie back to the casing 36 and optionally a seal between the upper (lined) portion of the wellbore and the lower (lined) borehole 34, depending upon the composition of the material 38.

With the embodiment shown in FIG. 2, there is no pressure exposure to the formation, full bore access is still possible, the conduit 30 may be expanded in a single pass (multiple passes possible) and it may be used to anchor and set in an open hole. Additionally, it provides a tie back to the casing 36 in a single pass of the expander device 42. It should be noted that the method described with reference to FIG. 2 is intended to tie back the casing in a single pass, but multiple passes and/or expansions are possible.

It should also be noted that successive lengths of expandable conduit may be coupled to casings or liners thereabove using the same method. Thus, the method(s) described herein may be used to line or case a borehole without the use of cement.

Figures 3A, 3B, 3C, 3D:
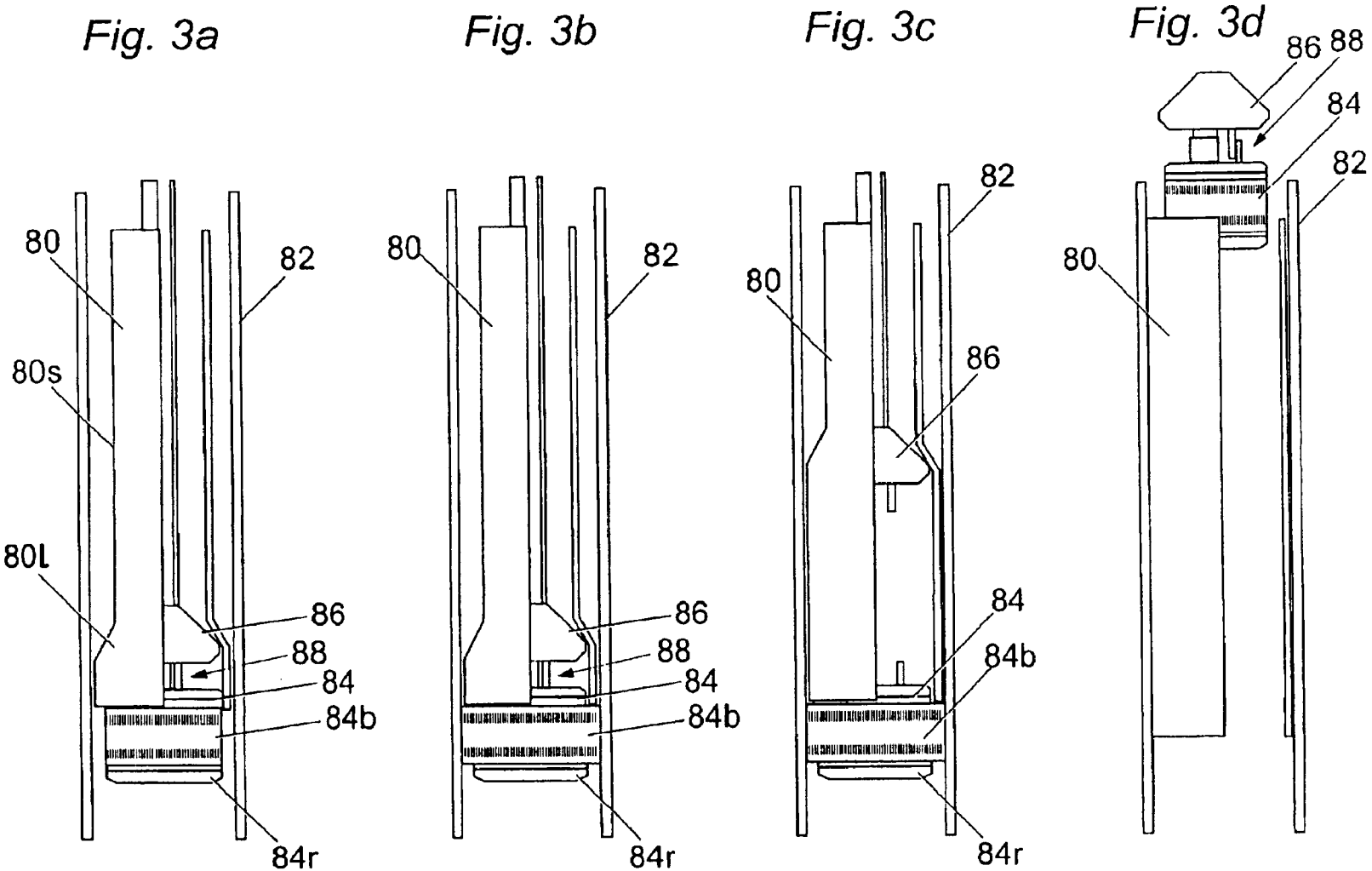
FIGS. 3*a* to 3*d* are successive stages in anchoring and expanding an expandable conduit within a second conduit using a third embodiment of an inflatable device.

Referring to FIG. 3, there is shown in sequence (FIGS. 3*a* to 3*d*) successive stages of anchoring an expandable conduit 80 to a casing 82 provided in a borehole (not shown), the borehole typically being drilled to facilitate the recovery of hydrocarbons.

An inflatable device 84 is releasably attached to a lower end 80*l* of the expandable conduit 80 before the conduit 80 is inserted into the casing 82. The expander device 86 is located within the lower end 80*l* of the conduit 80, the lower end 80*l* being expanded to accommodate the expander device 86. Similar to the previous embodiment, the inflatable device 84 has the expander device 86 releasably coupled thereto via a coupling 88. Otherwise, the inflatable device 84 and the expander device 86 are substantially the same as the previous embodiments.

Referring to FIG. 3*a*, the casing 80 with the inflatable device 84 attached thereto and the expander device 86 located therein is run into the hole to the required setting depth. It will be appreciated that although FIGS. 3*a* to 3*d* show the inflatable device 84 releasably attached to the lower end 80*l* of the conduit 80, the inflatable device 84 may be releasably attached at or near an upper end of the conduit 80.

The inflatable device 84 may be of any suitable configuration, but is typically a device that has an inflatable annular balloon-type portion 84*b* that is mounted on an annular ring 84*r*. The annular ring 84*r* allows a string, wireline or the like to be passed through the inflatable device 84 as required. This is particularly advantageous where the inflatable device 84 and/or the expander device 86 are positioned at the upper end of the conduit 80.

Referring to FIG. 3*b*, the inflatable device 84 is inflated to expand the inflatable annular balloon-type portion 84*b*. As the balloon-type portion 84*b* expands, it contacts the casing 82, thus providing an anchor between the conduit 80 and the casing 82. This contact between the balloon-type portion 84*b* and the casing 82 provides an anchor point and/or a seal between the conduit 80 and the casing 82.

It should be noted that in this embodiment, the forces applied to the conduit 80 by subsequent movement of the conduit 80, that is by pushing or pulling on the conduit 80 for example, will be transferred to the casing 82 via the inflatable device 84. However, unlike conventional slips, the inflated balloon-type portion 84*b* is less likely to damage the casing. Additionally, the size of the balloon-type portion 84*b* can be chosen whereby it is sufficiently large so as not to lose its grip on the casing 82, even when the inflatable device 84 is moved upwardly or downwardly.

The expander device 86 is pulled through the expandable conduit 80 to radially expand the conduit 80, as shown in FIG. 3*c*. The expander device 86 can be propelled through the conduit 80 in any conventional manner, as with the previous embodiments.

Also, and as with the previous embodiments, an outer surface 80*s* of the conduit 80 can be provided with a friction and/or sealing material. The friction and/or sealing material may comprise, for example, any suitable type of rubber or other resilient materials. For example, the friction and/or sealing material can be configured in a similar way to the friction and/or sealing material 100, 122 described above with reference to FIGS. 4 to 6.

Additionally, the conduit 80 may be provided with friction and/or sealing material (e.g. material 100, 122) at a lower end 80*l* of the conduit 80 to enhance the anchoring effect at this portion of the conduit 80. Additionally, the friction and/or sealing material can be provided at various spaced-apart locations along the length of the conduit 80 to enhance the coupling between the conduit 60 and the casing 82.

As the expander device 86 is pulled upwards, the upward movement thereof is stopped after a predetermined time or distance, at which point the expander device 84 is lowered until the coupling 88 between the expander device 86 and the inflatable device 86 latches. As with the previous embodiments, the inflatable balloon-type portion 84*b* is automatically deflated and further upward movement of the expander device 86 causes the inflatable device 84 also to move upward, as shown in FIG. 3*d*. It should be noted that the upward movement of the expander device 86 should only be stopped once a sufficient length of conduit 80 has been expanded to provide a sufficient anchor.

The expander device 86 is continually pulled upwards towards the surface until the conduit 80 is fully expanded to contact the casing 82. Thereafter, the inflatable device 84 and the expander device 86 may be removed from the borehole at the surface.

Anchoring and expanding the conduit 80 in this way has the same advantages as in the previous embodiment, but the FIG. 3 embodiment is designed to anchor and set in cased hole rather than open hole.

The method and apparatus described herein may be used for a plurality of different downhole functions relating to the use of expandable conduit. For example, they may be used where the original liner or casing requires to be repaired due to damage or the like by overlaying the damaged portion with a portion of expandable conduit. They may also be used to tie back to the liner or casing, as described herein.

Thus, there is provided in certain embodiments an apparatus and method of anchoring an expandable conduit to a second conduit. The apparatus and method of certain embodiments provide numerous advantages over conventional mechanical anchoring devices, such as slips, particularly by reducing the potential damage to conduits that mechanical slips may cause. Certain embodiments of apparatus and methods involve the use of an inflatable device that can either be a) attached directly at or near the top or bottom of the expandable conduit, or b) placed within the top or bottom of the expandable conduit. In a), anchoring forces are generated as a result of friction between the inflatable device and the second conduit, the forces being passed into the conduit via the inflatable device. In b), anchoring forces are generated by friction between an outer surface of the expandable conduit and the second conduit, the forces being substantially passed into the second conduit directly via the expandable conduit. The outer surface of the expandable conduit may be suitably prepared (ie provided with a friction enhancing material) to increase the strength of the anchor.

Modifications and improvements may be made to the foregoing without departing from the scope of the present invention.

What is claimed is:

1. Apparatus for anchoring a first conduit to a second conduit, the apparatus comprising: an inflatable device for engaging with the first conduit, wherein the inflatable device is inflatable to facilitate anchoring of the first conduit to the second conduit; and an expander device to expand a length of the first conduit.

2. Apparatus according to claim 1, wherein the first conduit is an expandable conduit.

3. Apparatus according to claim 1, wherein the first conduit comprises any type of expandable conduit that is capable of sustaining deformation.

4. Apparatus according to claim 1, wherein the first conduit is selected from the group of conduits consisting of expandable liner and expandable casing.

5. Apparatus according to claim 1, wherein the second conduit is selected from the group of conduits consisting of liner, casing and boreholes.

6. Apparatus according to claim 1, wherein the expander device is telescopically coupled to the inflatable device, so that when the expander device is moved a certain distance, the inflatable device is deflated and subsequently moves with the expander.

7. Apparatus according to claim 1, wherein the expander device is releasably attached to the inflatable device.

8. Apparatus according to claim 7, wherein the expander device is releasably attached to the inflatable device using a latch mechanism.

9. Apparatus according to claim 1, wherein the inflatable device is located within the first conduit.

10. Apparatus according to claim 1, wherein the inflatable device is coupled near an end of the first conduit.

11. Apparatus according to claim 1, wherein the inflatable device is inflated to expand the first conduit whereby the first conduit contacts the second conduit, thereby providing an anchor.

12. Apparatus according to claim 1, wherein the first conduit is provided with a slotted portion to facilitate expansion.

13. Apparatus for anchoring a first conduit to a second conduit, comprising: an inflatable device for engaging with the first conduit, wherein the inflatable device is inflatable to facilitate anchoring of the first conduit to the second conduit, and wherein the inflatable device comprises an inflatable balloon portion coupled to a ring.

14. Apparatus for anchoring a first conduit to a second conduit, comprising: an inflatable device for engaging with the first conduit, wherein the inflatable device is inflatable to facilitate anchoring of the first conduit to the second conduit, and wherein, on inflation of the inflatable device, a portion thereof directly contacts the second conduit to provide an anchor.

15. A method of anchoring a first conduit to a second conduit, comprising: providing the first conduit, an expander device, and an inflatable device in contact with the first conduit, running the first conduit and inflatable device into the second conduit, inflating the inflatable device to facilitate anchoring of the first conduit to the second conduit, and expanding a length of the first conduit with the expander device.

16. A method of anchoring an expandable conduit to a second conduit, comprising: the steps of providing the expandable conduit, running the expandable conduit into the second conduit, passing an assembly comprising an inflatable device and an expander into the expandable conduit, inflating the inflatable device to facilitate anchoring of the expandable conduit to the second conduit, and expanding a length of the expandable conduit with the expander device.

17. A method according to claim 16, wherein the method further includes deflating the inflatable device, removing the expander device from the expandable conduit and removing the inflatable device from the expandable conduit.

18. A method according to claim 16, wherein the method further includes attaching the expander device to the inflatable device, deflating the inflatable device, removing the expander device from the expandable conduit and removing the inflatable device from the expandable conduit.

19. The method according to claim 16, wherein the assembly is disposed within the expandable conduit during the running.

20. The method according to claim 16, wherein the expander device of the assembly is disposed within the expandable conduit and the inflatable device is disposed outside the expandable conduit during the running.

21. A method of anchoring an expandable conduit within a wellbore, comprising:

running the expandable conduit into the wellbore;

passing an assembly comprising a pressure actuated radially expandable device and an expandable device into the expandable conduit;

actuating the expandable device to facilitate anchoring of the expandable conduit in the wellbore, and expanding a length of the expandable conduit with the expander device.

* * * * *

UNITED STATES PATENT AND TRADEMARK OFFICE

CERTIFICATE OF CORRECTION

PATENT NO. : 6,860,329 B1
APPLICATION NO. : 10/069992
DATED : March 1, 2005
INVENTOR(S) : Oosterling It is certified that error appears in the above-identified patent and that said Letters Patent is hereby corrected as shown below:

In the Claims:

Column 12, Claim 13, Line 2: After "ring", insert --; and an expander device to expand a length of the first conduit--

Column 12, Claim 14, Line 9: After "anchor", insert --; and an expander device to expand a length of the first conduit--

Column 12, Claim 16, Line 18: Delete "the steps of"

Signed and Sealed this

Thirtieth Day of January, 2007

JON W. DUDAS
*Director of the United States Patent and Trademark Office*